United States Patent [19]

Saba

[11] Patent Number: 4,926,293

[45] Date of Patent: May 15, 1990

[54] LIGHTING AND AIR FRESHENER FIXTURE

[76] Inventor: Mounir G. Saba, #1905, 1115 Sherbrooke W., Montreal, Quebec, Canada, H3A 1H3

[21] Appl. No.: 305,382

[22] Filed: Feb. 1, 1989

Related U.S. Application Data

[63] Continuation-in-part of Ser. No. 141,627, Jan. 6, 1988, Pat. No. 4,829,411, which is a continuation-in-part of Ser. No. 95,102, Sep. 10, 1987, abandoned.

[51] Int. Cl.[5] ..... F21V 33/00

[52] U.S. Cl. ..... 362/96; 362/149; 362/294; 362/345; 362/802; 98/40.08

[58] Field of Search ..... 98/40.07, 40.08, 40.09; 362/149, 253, 227, 234, 294, 345, 373, 802, 804, 96; 55/385.1

[56] References Cited

U.S. PATENT DOCUMENTS

| | | | |
|---|---|---|---|
| 1,390,950 | 9/1921 | Avery | 104/52 |
| 2,131,054 | 9/1938 | Kurth | 362/294 |
| 2,189,008 | 2/1940 | Kurth | 362/294 X |
| 2,255,849 | 9/1941 | Kurth | 362/294 |
| 2,265,903 | 12/1941 | Hartje | 362/294 |
| 2,282,587 | 5/1942 | Kurth | 362/294 |
| 2,627,217 | 2/1953 | Hainke et al. | 98/1 |
| 2,982,196 | 5/1961 | Sherron | 98/33 |
| 3,071,059 | 1/1963 | Schleifer | 362/294 |
| 3,096,933 | 7/1963 | Bora | 230/235 |
| 3,101,038 | 8/1963 | Archer | 362/149 X |
| 3,846,072 | 11/1974 | Patterson | 362/373 X |
| 3,890,126 | 6/1975 | Joseph | 362/294 X |
| 4,109,144 | 8/1978 | Vidmar | 362/247 |
| 4,227,191 | 10/1980 | Raber | 340/268 |
| 4,257,039 | 3/1981 | Webb et al. | 340/269 |
| 4,449,166 | 5/1984 | Sharp | 362/373 X |
| 4,617,821 | 10/1986 | Yokoyama et al. | 73/23 |
| 4,711,161 | 12/1987 | Swin, Sr. et al. | 98/31.5 |

*Primary Examiner*—Stephen F. Husar

*Attorney, Agent, or Firm*—James R. Longacre; Michael L. Keller

[57] ABSTRACT

The present invention relates to an apparatus for illuminating and for collecting air which is contaminated by a certain substance in the adjacent area of the apparatus. The latter includes a reflector defining an internal cavity in which is mounted a light source. A conduit is mounted to the reflector and communicates with the internal cavity thereof. A blower unit is mounted within the reflector for drawing contaminated air and expelling it through the conduit. Advantageously, a filter element is located within the conduit to remove the contaminant from the air mass passing through the conduit.

12 Claims, 6 Drawing Sheets

LIGHTING AND AIR FRESHENER FIXTURE

This application is a continuation-in-part of Ser. No. 141,627, filed Jan. 6, 1988 and entitled Lighting and Air Freshener Fixture, now U.S. Pat. No. 4,829,411 which is a continuation-in-part of Ser. No. 095,102, filed Sept. 10, 1087, now abandoned.

FIELD OF THE INVENTION

The present invention relates to an apparatus for illuminating and for purifying, at a certain extent, the air in the adjacent area of the apparatus. More particularly, the invention relates to a combination of a lighting unit and a device to collect air contaminated by cigarette smoke or the like, toxic products, etc., in the adjacent area of the lighting unit.

BACKGROUND OF THE INVENTION

Pollution of air by cigarette smoke in public places such as night clubs, bars, restaurants, clinics, trains, boats or the like, has become a major concern for non-smokers especially after the noxious effects of the cigarette for the health have been clearly established in the recent years.

Problems of similar nature are experienced by employees in industrial plants who are subjected to a variety of toxic substances released in the air which are prone to contaminate the workplace to such an extent to create a serious health hazard.

To the best knowledge of the present inventor, there has not been available yet a device to purify the air from contaminants in public places, industrial plants or the like which is efficient and at the same time is relatively inexpensive and simple to operate.

OBJECTS AND STATEMENT OF THE INVENTION

Therefore, an object of this invention is an apparatus for collecting air contaminated by cigarette smoke or the like, toxic substances, etc., from the area which surrounds the apparatus.

The object of this invention is achieved by providing a lighting unit such as a lamp with a device to collect the contaminated air from the adjacent area of the lighting unit.

More specifically, in a first embodiment, the lighting unit is provided with a reflector, a light source such as a fluorescent or an incandescent lamp and an air propelling means such as a blower unit preferably mounted within the reflector.

An opening of a suitable size, depending upon the capacity of the blower unit is formed in the reflector and communicates with a conduit of an appropriate size, the conduit and the reflector forming a passage to convey air. In the passage is mounted a filter to remove, at least partially, the contaminant from the air passing through the passage. If desired, an ionizer may also be installed within the passage.

The reflector plays an important role in the air collecting process since it acts as a hood for the blower unit in addition to reflecting the light produced by the light source.

To avoid a continual operation of the blower unit, a switch responsive to the contaminant present in the air may be provided to activate the blower unit only when the concentration of contaminant exceeds a predetermined level. When the concentration of contaminant drops below the predetermined level, the switch will shut-off the blower unit to reduce the electrical consumption of the apparatus.

In a variant, an additional conduit connected to a source of fresh air is provided to deliver fresh air around the reflector.

In a second embodiment, a plurality of lighting units are grouped together as a central system. Each lighting unit comprises a reflector with a suitable light source and a conduit mounted to the reflector. The conduits of all the lighting units are connected to a common duct which leads outside the enclosure in which the lighting units are installed or may be connected to a suitable air filtering device. In the duct is mounted an air propelling means such as a central blower unit which creates a suction in the duct to collect contaminated air in the enclosure through the reflectors of the lighting units and discharge the contaminated air through the duct, outside or through the filtering device.

The operation of the blower unit may be controlled by a suitable switch responsive to the contaminant present in the enclosure so as to activate the central blower unit when the concentration of contaminant in the air exceeds a predetermined level.

In a variant of the second embodiment an additional conduit may be connected to each reflector to supply fresh air around the lighting units.

As it will be apparent to those skilled in the art, the apparatus according to this invention provides numerous advantages in that it allows the air to be maintained at relatively clean levels, uniformizes the temperature in the room by creating an air circulation and helps to keep an acceptable level of humidity in the room.

Therefore, the present invention comprises in a general aspect an apparatus for illuminating and for collecting air from the adjacent area of the apparatus, the air in the adjacent area being contaminated by a certain substance, the apparatus comprising:

- a passage for conveying air, said passage having an open end;
- light producing means mounted within said passage for projecting light through said open end;
- air propelling means mounted within the passage, the air propelling means collecting contaminated air from the adjacent area of the apparatus and conveying the contaminated air through the passage; and
- filter means in said passage to filter the air passing therethrough.

The present invention also comprises a system for illuminating and for collecting air from an enclosure, the air in said enclosure being contaminated by a certain substance, the system comprising:

- a plurality of lighting units mounted within the enclosure, each lighting unit including:
  - (a) a reflector defining an internal cavity;
  - (b) light producing means mounted to the reflector within the internal cavity; and
  - (c) conduit means mounted to the reflector and communicating with the internal cavity;
- duct means, communicating with the conduit means of each lighting unit, said duct means and said conduit means forming an air passage;
- air propelling means mounted within the air passage to convey air therein; and
- filter means in the air passage to remove contaminants from the air passing through the air passage.

DESCRIPTION OF PREFERRED EMBODIMENTS

Figure 1:
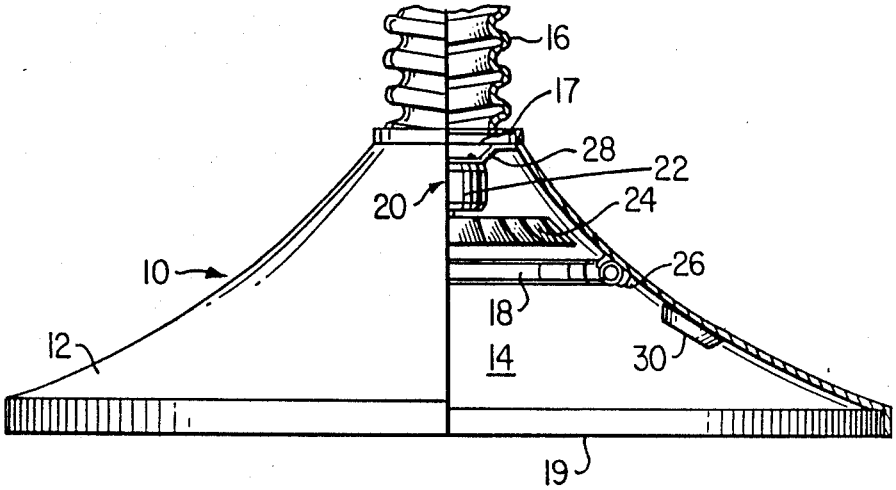
FIG. 1 is an elevational view partly in section of an apparatus according to a first embodiment of this invention.

Referring now to the drawings, more particularly to FIG. 1, the apparatus for illuminating and purifying the air from the adjacent area of the apparatus, according to a first embodiment, comprises a lighting unit generally designated by the reference numeral 10 and including a conical reflector 12 defining an internal cavity 14 communicating with a flexible conduit 16 through a port 17 formed at the upper end of the reflector 12. At the opposite end of the reflector 12 is formed a large opening 19 having a circular or an oval shape.

The reflector 12 is suspended from a ceiling or the like by the conduit 16 which leads outside the room in which the lighting unit 10 is installed. When a plurality of lighting units 10 are mounted in the same room, it may be advantageous to connect all the conduits 16 to a common duct (not shown in the drawings) which is connected to a suitable outlet.

Within the cavity 14 are mounted a fluorescent annular lamp 18 and a blower unit 20, the latter including an electric motor 22 driving an impeller 24. The fluorescent lamp 18 and the electric motor 22 are mounted to the reflector 12 by means of suitable brackets 26 and 28, respectively.

A switch 30, responsive to a contaminating substance which may be present in the air is serially connected to the electrical motor 22 and is mounted to the reflector 12, within the cavity 14 by any suitable means such as by glue or screws.

In the particular embodiment shown in FIG. 1, the lighting unit 10 is to be installed in bars, restaurants or the like, where cigarette smoke is present in the air and constitutes the above-mentioned contaminating substance. Therefore, in this particular case the switch 30 is of such type so as to respond to smoke in order to activate the blower unit 20 when the concentration of smoke exceeds a predetermined level.

As an example, the switch 30 may be constituted by a modified smoke detector which is normally used for sounding an alarm when too much smoke is present in the air. Such smoke detectors are commercially available and are used to warn in case of fire.

To modify the smoke detector, the sound producing device thereof which typically is a buzzer, is removed and replaced with a relay. The normally opened contacts of the relay are then connected serially with the motor 20 so that when the concentration of smoke exceeds a predetermined level at which the smoke detector has been set, the motor 20 is activated.

When the lighting unit 10 is installed in a different environment contaminated by a substance other than smoke, a different type of switch 30 will have to be used, according to the contaminant. A variety of switches responsive to different contaminants are commercially available. By selecting the appropriate switch the lighting unit 10 may be easily adapted for a specific application.

The wiring for the lamp 18 and the electric motor 22 is mounted within the conduit 16.

The interconnection scheme between the terminals of the switch 30, the terminals of the electric motor 22 and the power supply leads for the electric motor 22 has not been described in detail here since it is well within the reach of a man skilled in the art.

It should be appreciated that the switch 30 is not essential to the invention and it may be omitted or it may be replaced by a conventional manually operated switch.

Figure 2:
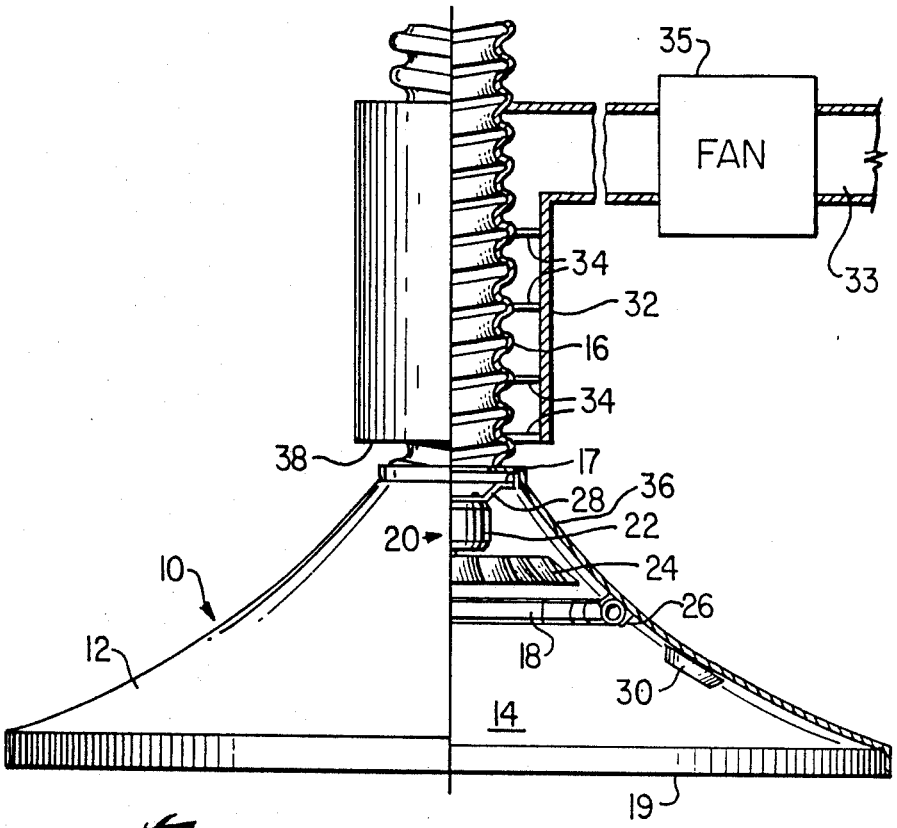
FIG. 2 is an elevational view partly in section of a variant of the apparatus shown in FIG. 1.

In a variant, shown in FIG. 2, the lighting unit 10 is provided with a sleeve 32 mounted coaxially over the conduit 16 by means of spacers 34 and terminating short of the outer walls 36 of the reflector 12 in order to define an annular outlet 38. The sleeve 32 communicates with a source of fresh air such as in inlet 33 outside the room in which the lighting unit 10 is installed and is provided with a fan 35.

Figure 3:
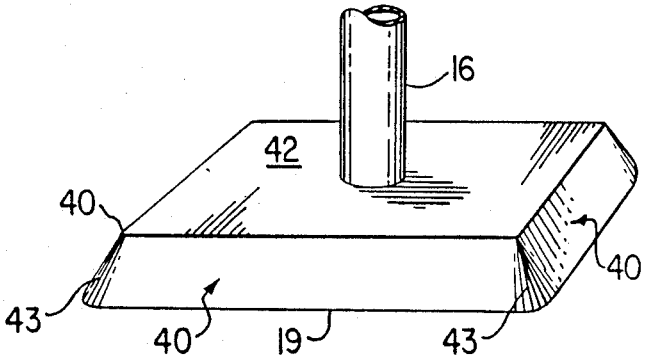
FIG. 3 is a perspective view of a reflector of a lighting unit according to this invention.

In most cases, the opening 19 of the reflector 12 through which air is drawn or expelled would have a circular or an oval shape. However, it may be envisaged to provide a reflector which defines a substantially rectangular opening as shown in FIG. 3.

The operation of the lighting unit shown in FIGS. 1 and 2 is as follows.

The lighting unit 10 is preferably mounted over a table, a bar or the like in order to illuminate the surface thereof in a conventional manner. When the concentration of smoke in the vicinity of the switch 30 exceeds a predetermined level, the switch 30 activates the blower unit 20 so that the blower unit 20 draws smoke and expels the smoke through the conduit 16.

Figure 4:
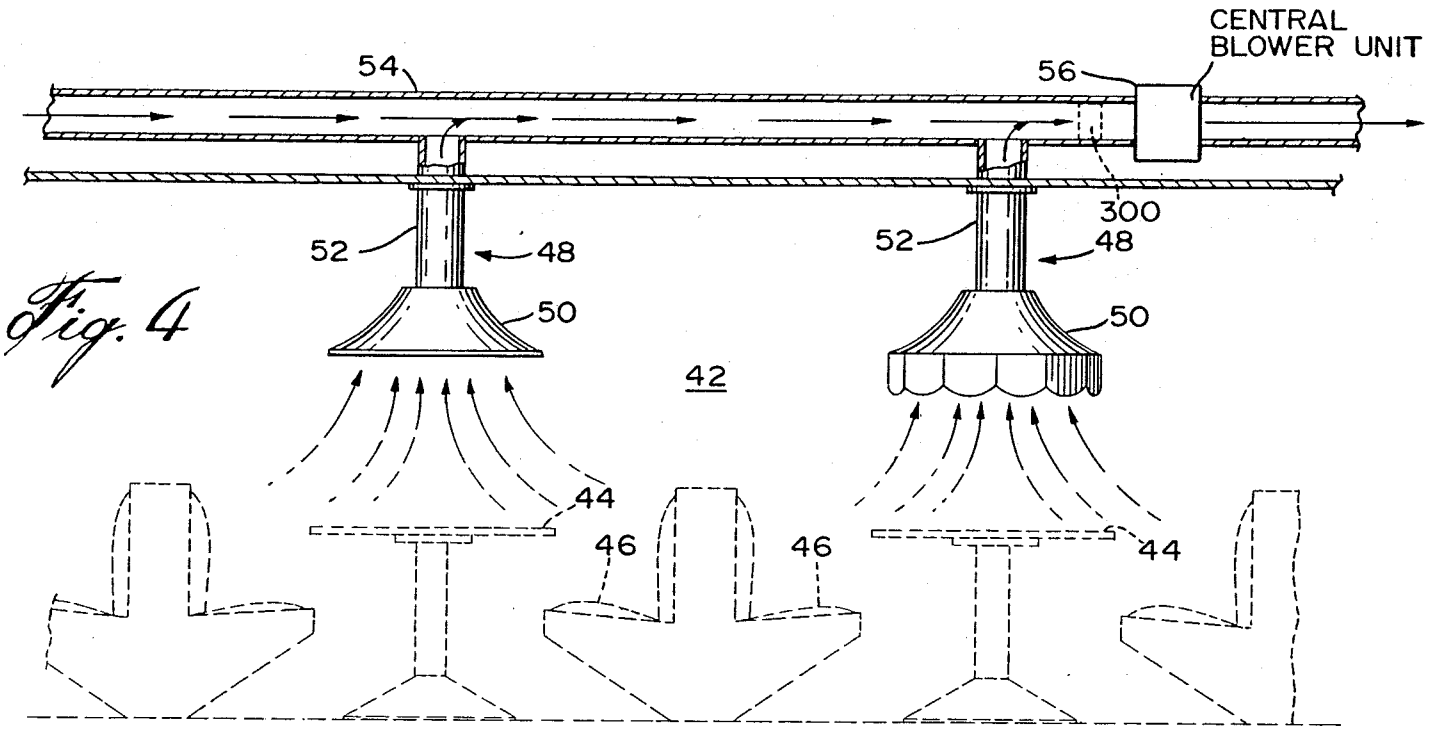
FIGS. 4, 5 and 6 illustrate various embodiments of a central system for illuminating and purifying the air in an enclosure.
Figure 5:
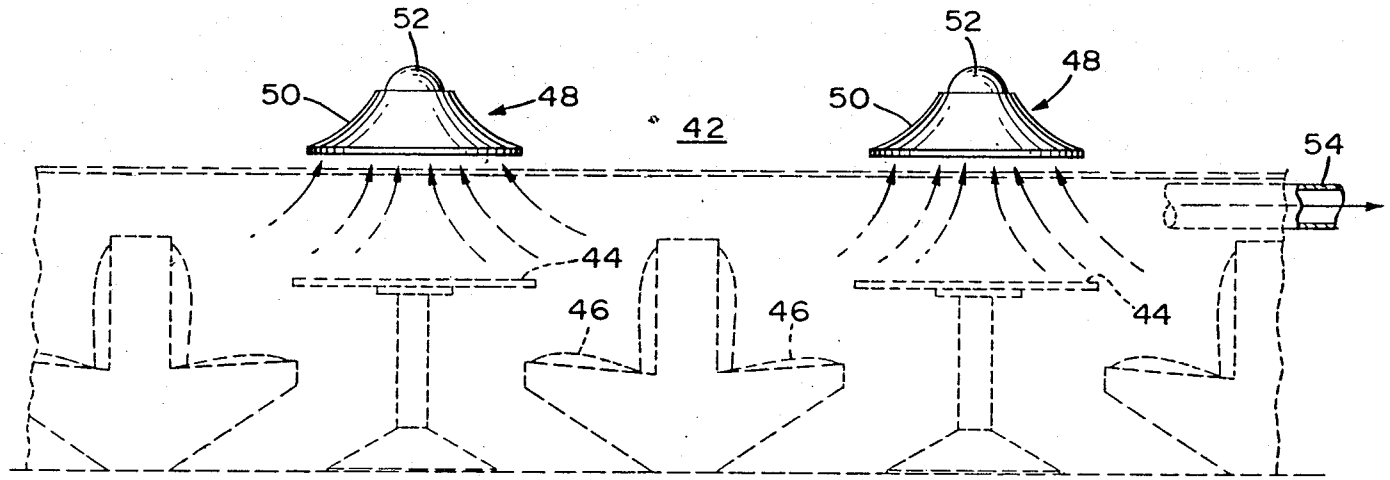
Figure 6:
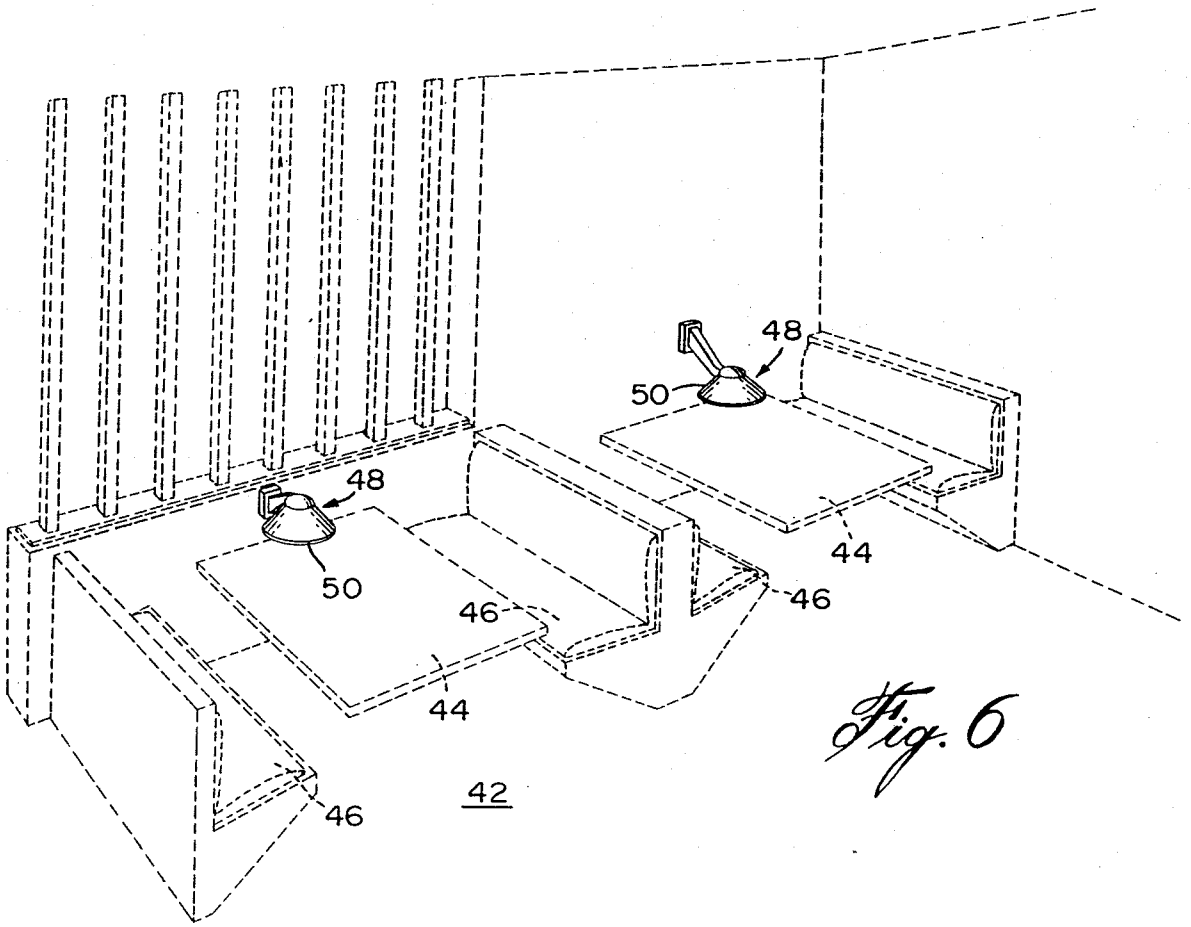

Another embodiment of this invention is illustrated in FIGS. 4, 5 and 6 which are schematical views of a room such as a restaurant in which is installed a system for providing illumination and at the same time to help maintain the air in the room clean, by collecting the smoke which may be present in the room.

More particularly, the room which is identified generally by the reference numeral 42 is provided with tables 44 and chairs 46 as it is customary in the art. In the room are also mounted a plurality of lighting units 48 above the tables 44, each lighting unit 48 comprising a reflector 50 suspended from the ceiling by a hollow, preferably flexible conduit 52 or directly fixed over the partition between the tables as shown in FIGS. 5 and 6. The reflector 50 is of similar construction to the reflector 12 previously described, in that it comprises a suitable light source and a port to communicate with the conduit 52, however, depending upon the installation, the blower 20 installed in the reflector 12 could be omitted from the reflector 50 if required.

The conduits 52 of the lighting units 48 are connected to a duct 54 in which is installed a central blower unit 56 known in the art and which is of the type comprising an electric motor driving an impeller. The duct 54 leads outside the room 42. If it is not desired to discharge the air outside, a filter may be provided in the duct 54 to remove the contaminants present in the air so that purified air is returned to the room 42. The filter is schematically shown at 300 in FIG. 4.

A smoke responsive switch, similar to the switch 30 illustrated in FIGS. 1 and 2, is mounted in each reflector 50. All smoke responsive switches are connected in parallel to each other and in series with the motor of the blower unit 56. As is the case with the previous embodiments, the smoke responsive switch may be omitted or replaced with an ordinary ON/OFF switch.

In a variant, each conduit 52 may be provided with an outer sleeve, in a similar manner to the embodiment illustrated in FIG. 2, to deliver fresh air in the room 42.

Preferably, all the sleeves for supplying fresh air are connected to a common duct which communicates with a source fresh air. This arrangement reduces the piping in the room 42 for, in turn, reducing the installation costs of the lighting units 48. However, it may very well be envisaged to route each sleeve for supplying fresh air of each lighting unit 48 directly to the source of fresh air without connecting the sleeves to a common duct.

Figures 7, 8:
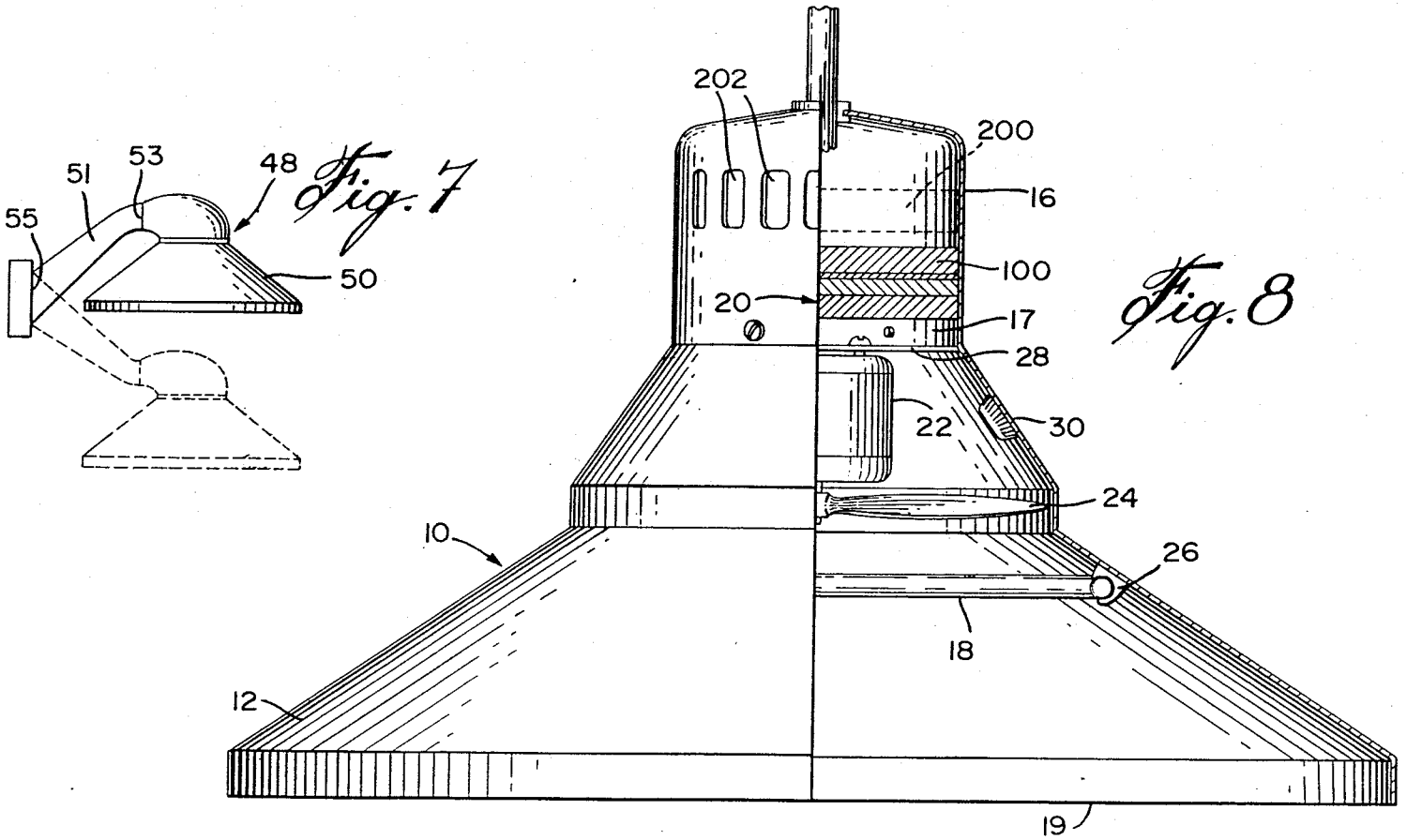
FIG. 7 is an enlarged elevational view of a lighting unit of the installation shown in FIGS. 5 and 6.
FIG. 8 is an elevational view partly in section of an apparatus according to another embodiment of this invention.

FIG. 7 is an enlarged view of a lighting unit 48 of the installation in FIGS. 5 and 6. The lighting unit 48 comprises a reflector 50 connected to a duct 51 by means of a swivel joint 53 known in the art. The opposite end of the duct 51 is mounted to a supporting structure also by means of a swivel joint 55. This arrangement allows to lower the reflector 50, as shown in dotted lines.

In the embodiment shown in FIG. 8, a filtering device 100 is mounted within a relatively short conduit 16 for discharging the filtrated air in the room where the lighting fixture is installed, through radial ports 202 in the conduit 16. The filter 100, mounted above the blower unit 20, is of known construction and for that reason it will not be described in detail. If desired, an ionizer of known construction may be mounted adjacent the filter 100. The ionizer is schematically shown at 200. As is the case with the previous embodiment, the switch 30 may be omitted or it may be replaced with ordinary ON/OFF switch.

The embodiment shown in FIG. 8 is well suited for applications where it is desirable to isolate as much as possible the enclosure where the lighting fixture is installed, from the outdoors, be it for the purpose of reducing the heating costs during the winter period of the year.

Discharging the filtrated air directly in the room, instead of discharging the contaminated air outdoors, greatly reduces the air circulation between the room and the outdoors.

The method of operation of the systems illustrated in FIGS. 4, 5 and 6 is very similar to the description given in conjunction with the embodiments illustrated in FIGS. 1 and 2. Suffice it to say that when the concentration of smoke in one of the reflectors 50 exceeds the predetermined level at which the smoke responsive switch mounted in the reflector has been set to activate the central blower unit 56, air will be collected by each one of the lighting units and expelled through the common duct 54. Since the smoke responsive switches of the lighting units 48 are connected in parallel, the central blower unit 56 will continue to operate until the smoke concentration in all the reflectors is reduced to an acceptable level.

The present invention has been described with reference to preferred embodiments and it should be clearly understood that this description is not to be interpreted in any limiting manner since these embodiments may be refined and modified in various ways. The scope of the invention is defined in the annexed claims.

I claim:

1. A system for illuminating and for collecting air from an enclosure, the air in said enclosure being contaminated by a certain substance, said system comprising:

a plurality of lighting units mounted within said enclosure, each lighting unit including:

(a) a reflector defining an internal cavity;

(b) light producing means mounted to said reflector within said cavity; and (c) conduit means mounted to said reflector and communicating with said internal cavity;

duct means communicating with the conduit means of each lighting unit;

air propelling means mounted within said duct means to convey therethrough contaminated air from said enclosure; and filter means in said duct means to filter the contaminated air conveyed therethrough.

2. An apparatus for illuminating and for collecting air from the adjacent area of said apparatus, the air in said adjacent area being contaminated by a certain substance, said apparatus comprising:

a reflector formed with conduit means to define an internal cavity, said cavity defining a duct capable of conveying air;

light producing means mounted to said reflector within said internal cavity;

air propelling means mounted to said reflector within said internal cavity to convey in said duct contaminated air from said adjacent area; and filter means within said duct to filter the contaminated air conveyed therein.

3. An apparatus as defined in claim 2, wherein said air propelling means comprises an electrical motor and an impeller operatively connected to said electrical motor.

4. An apparatus as defined in claim 2, wherein said reflector has a portion of conical shape.

5. An apparatus as defined in claim 2, wherein said light producing means comprises a fluorescent lamp.

6. An apparatus for illuminating and for collecting air from the adjacent area of said apparatus, the air in said adjacent area being contaminated by a certain substance, said apparatus comprising:

a reflector defining an internal cavity;

light producing means mounted to said reflector within said internal cavity;

conduit means connected to said reflector and communicating with said internal cavity, said conduit means and said reflector defining a passage for conveying air;

air propelling means mounted within said passage to convey therein contaminated air from said adjacent area;

filter means within said passage to filter the contaminated air conveyed therein; and a duct having (a) a first end terminating short of said reflector and defining an outlet, and (b) a second, opposite end communicating with a source of fresh air, wherein said duct comprises means to supply fresh air from said source in said adjacent area through said outlet.

7. An apparatus as defined in claim 6, wherein said apparatus further comprises fan means mounted within said duct.

8. An apparatus as defined in claim 6, wherein said air propelling means includes an electrical motor to which is operatively connected an impeller, said electrical motor being connectable to a source of electrical energy by conductors, said conductors being mounted within said conduit means.

9. An apparatus as defined in claim 6, wherein said reflector is suspended by said conduit means from a support.

10. An apparatus as defined in claim 6, wherein said conduit means is flexible.

11. An apparatus for illuminating and for collecting air from the adjacent area of said apparatus, the air in said adjacent area being contaminated by a certain substance, said apparatus comprising:

a reflector defining an internal cavity;

light producing means mounted to said reflector within said internal cavity;

conduit means connected to said reflector and communicating with said internal cavity, said conduit means and said reflector defining a passage for conveying air;

a swivel joint for connecting said reflector to said conduit means;

air propelling means mounted within said passage to convey therein contaminated air from said adjacent area; and filter means within said passage to filter the contaminated air conveyed therein.

12. An apparatus for illuminating and for collecting air from the adjacent area of said apparatus, the air in said adjacent area air being contaminated by a certain substance, said apparatus comprising:

a passage for conveying air, said passage having an open end;

light producing means mounted within said passage for projecting light through said open end;

air propelling means mounted within said passage to convey therein contaminated air from said adjacent area;

filter means in said passage to filter the contaminated air conveyed therein; and an ionizer disposed in said passage.

* * * * *